US009548535B1

(12) United States Patent
Kuo

(10) Patent No.: US 9,548,535 B1
(45) Date of Patent: Jan. 17, 2017

(54) PHASE-CONTROLLED ANTENNA WITH INDEPENDENT TUNING CAPABILITY

(71) Applicant: AMAZON TECHNOLOGIES, INC, Reno, NV (US)

(72) Inventor: Jerry Weiming Kuo, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 334 days.

(21) Appl. No.: 13/787,631

(22) Filed: Mar. 6, 2013

(51) Int. Cl.
*H01Q 3/34* (2006.01)

(52) U.S. Cl.
CPC ..... *H01Q 3/34* (2013.01)

(58) Field of Classification Search
USPC ..... 343/833, 834
See application file for complete search history.

(56) References Cited

U.S. PATENT DOCUMENTS 4,766,438 A * 8/1988 Tang ..... H01Q 3/24 342/372
7,095,382 B2 * 8/2006 Surducan et al. ..... 343/793
8,217,841 B2 * 7/2012 Hossain et al. ..... 343/700 MS
8,462,055 B2 * 6/2013 Jin et al. ..... 343/702
8,587,486 B2 * 11/2013 Chiu et al. ..... 343/702
2006/0208956 A1 * 9/2006 Surducan et al. ..... 343/795
2010/0060544 A1 * 3/2010 Penev ..... H01Q 1/38 343/876
2010/0157858 A1 * 6/2010 Lee et al. ..... 370/297
2011/0105023 A1 * 5/2011 Scheer ..... H01Q 1/242 455/41.2
2014/0071000 A1 * 3/2014 Tani et al. ..... 343/700 MS

* cited by examiner

*Primary Examiner* — Sue A Purvis
*Assistant Examiner* — Noel Maldonado
(74) *Attorney, Agent, or Firm* — Lowenstein Sandler LLP

(57) ABSTRACT

Antenna structures and methods of operating the same of a phase-controlled antenna of an electronic device are described. A phase-controlled antenna includes a radio frequency (RF) feed, an antenna structured coupled to the RF feed and including a ground path coupled to a ground node, and a phase-controlling circuit coupled between the ground path and the ground node. The antenna structure is configured to operate at a resonant frequency in a first state, and the phase-controlling circuit is configured to introduce a phase shift in the antenna structure to change the resonant frequency of the antenna structure to a second resonant frequency in a second state.

17 Claims, 11 Drawing Sheets

PHASE-CONTROLLED ANTENNA WITH INDEPENDENT TUNING CAPABILITY

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high-band. One resonant mode in the lower frequency band and one resonant mode in the high-band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls and mobile TV, all in a mobile environment. The required frequency bands for 3G applications may be GSM850/EGSM in low-band and DCS/PCS/WCDMA in high-band. The 3G band is between 824 MHz and 960 MHz. Long Term Evolution (LTE) and LTE Advanced (sometimes generally referred to as 4G) bands are communication standards that have been standardized by the 3rd Generation Partnership Project (3GPP). However, in order to extend the frequency coverage down to 700 MHz for 4G/LTE application, antenna bandwidth needs to be increased especially in the low-band. There are two common LTE bands used in the United States from 704 MHz-746 MHz (Band 17) and from 746 MHz-787 MHz (Band 13). Conventional solutions increase the antenna size or use active tuning elements to extend the bandwidth. Alternatively, conventional solutions use separate antennas to achieve different frequency bands and use a switch to switch between the antennas.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Antenna structures and methods of operating the same of a phase-controlled antenna of an electronic device are described. A phase-controlled antenna includes a radio frequency (RF) feed, an antenna structured coupled to the RF feed and including a ground path coupled to a ground node, and a phase-controlling circuit coupled between the ground path and the ground node. The antenna structure is configured to operate at a resonant frequency in a first state, and the phase-controlling circuit is configured to introduce a phase shift in the antenna structure to change the resonant frequency of the antenna structure to a second resonant frequency in a second state. Phase shift (e.g., a phase advance or a phase delay) is any change that occurs in the phase of the RF signal and represents a "shift" from zero phase. In principle, any variable reactance in series or shunt across a transmission line can be used to introduce a phase shift. A phase delay (e.g., −180°) represents a phase shift from zero in a first direction and a phase advance (e.g., +180°) represents a phase shift from zero in a second direction.

In a phase-controlled antenna, both bandwidth and efficiency in the high-band can be limited by the space availability and coupling between the high-band antenna and the low-band antenna in a compact electronic device. In a constrained radiation space (low and thin profiles for mobile devices), antenna engineers face challenges to enlarge the bandwidth for the frequency bands between 700 MHz to 960 MHz, such as for LTE band to GSM 850 or GSM 900 bands, with sufficient antenna efficiency. The embodiments described herein can be used to tune the peak antenna efficiency for an individual band. The phase-controlling circuit can be used to improve radiation efficiency by controlling the phase of the antenna structure.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 1:
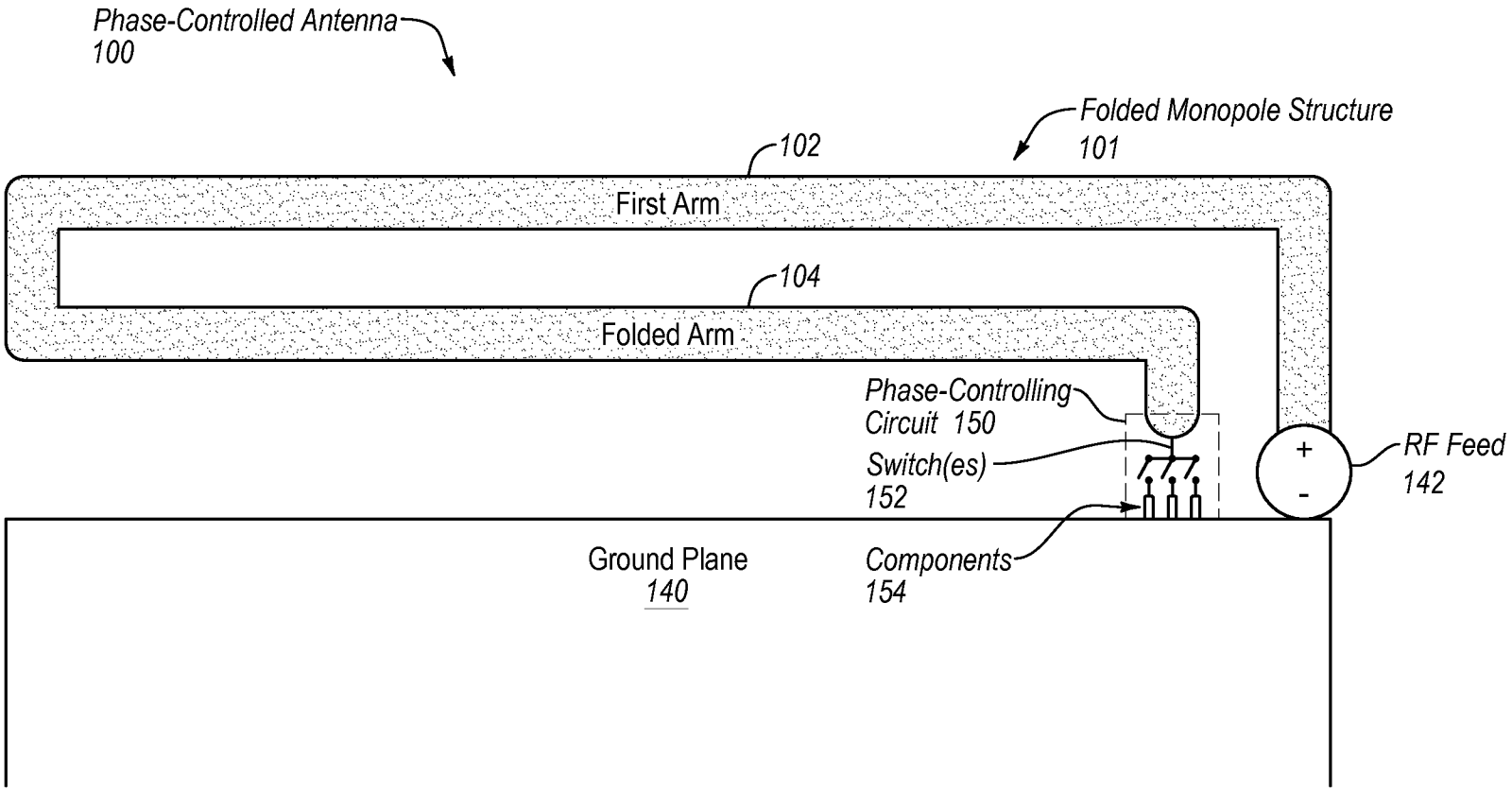
FIG. 1 illustrates one embodiment of a phase-controlled antenna including a folded monopole structure coupled to a phase-controlling circuit.

FIG. 1 illustrates one embodiment of a phase-controlled antenna 100 including a folded monopole structure 101 coupled to a phase-controlling circuit 150. The folded monopole structure 101 includes a first arm 102 and a folded arm 104. The first arm 102 is coupled to a radio frequency (RF) feed 142. The folded arm 104 is coupled to a grounding path, which is coupled to the phase-controlling circuit 150. In one embodiment, the phase-controlling circuit 150 includes one or more switches 152 and components 154. The switch(es) 152 and components 154 are configured to switch the ground path between different paths to ground, ground plane 140. For example, the phase-controlling circuit may be configured to switch the ground path between a first path coupled with the ground plane 140, a second path with a capacitor coupled in series with the ground plane 140, a third path with an inductor coupled in series with the ground plane 140. In one embodiment, the phase-controlling circuit includes a switching circuit coupled to the three paths, and the switching circuit is configured to connect the ground path to the first path to operate the folded monopole structure 101 at a resonant frequency. The switching circuit may also connect the ground path to the second path to shift up the resonant frequency to a second frequency. The switching circuit may also connect the ground path to the third path to shift down the resonant frequency to a second frequency. In one embodiment, the switch 152 is a single pole, triple throw (SPTT) switch. The SPTT switch includes a first terminal coupled to the ground path of the folded arm 104 and second, third, and fourth terminals are coupled to the first path, second path, and third path, respectively. In one embodiment, a control unit (not illustrated) is coupled to the phase-controlling circuit 150 and is configured to control the phase-controlling circuit using one or more control signals. In one embodiment, the control unit is a processing device of an electronic device, such as a tablet computer, a smart phone, a user device or the like. The control unit may also be a processing element within a device, such as within a wireless modem that is used to drive the folded monopole structure 101.

In another embodiment, the phase-controlling circuit comprises two paths or more than three paths. For example, in one embodiment, the phase-controlling circuit 150 includes a fourth path with a second capacitor coupled in series with the ground plane 140. The switching circuit is configured to connect the ground path to shift up the resonant frequency. This may be a higher or lower shift than the third path. For example, the first path may include a first capacitor of 18 pF and the fourth path may include a second capacitor of 6.8 pF. Alternatively, the fourth path may include a second inductor for shifting down the resonant frequency to another frequency than when shifting down with the first inductor of the second path. Alternatively, other components than capacitors and inductors may be used. For example, ferrite devices may be used, or other components that introduce an electrical phase advance or an electrical phase delay as described herein.

In another embodiment, the phase-controlling circuit 150 may include other types of circuits to introduce a phase shift in the antenna structure to change the resonant frequency to a second resonant frequency. In one embodiment, the phase-controlling circuit 150 includes a phase shifter. Various types of phase shifters may be used as described herein.

In other embodiments, other types of antenna structures may be used, such as a loop structure that includes a first end coupled to the RF feed 142 and a second end coupled to the phase-controlling circuit 150. In another embodiment, the folded monopole structure can have different configurations. For example, In one embodiment, the folded monopole structure includes a first arm, a second arm coupled to the first arm, and a folded arm coupled to a distal end of the first arm, the distal end being the end farthest from the RF feed 142. In another embodiment, the folded monopole structure further includes a third arm coupled to the distal end of the first arm and includes multiple traces like described below with respect to FIG. 7. In a further embodiment, the antenna structure includes a parasitic ground element coupled to a grounding point of the ground plane 140. An example of a parasitic ground element is illustrated and described below with respect to FIG. 7.

In one embodiment, the folded monopole structure 101 includes multiple portions: a first portion that extends from the RF feed 142 in a first direction until a first fold; a second portion that extends from the first fold in a second direction until a second fold; a third portion that extends from the second fold in a third direction until a third fold; a fourth portion that extends from the third fold in a fourth direction until a fourth fold and is laid out at least partially in parallel to the second portion; and a fifth portion that extends from the fourth fold in a fifth direction until the ground plane 140 and is laid out at least partially in parallel to the first portion. In another embodiment, the folded monopole structure 101 has a section at a distal end of the folded monopole structure 101 that is folded in the third direction towards the ground plane 140. This can be done to fit the folded monopole structure in a smaller volume while maintaining the overall length of the folded monopole structure 101. It should be noted that a "fold" refers to a bend, a corner or other change in direction of the antenna element. For example, the fold may be where one segment of an antenna element changes direction in the same plane or in a different plane. Typically, folds in antennas can be used to fit the entire length of the antenna within a smaller area or smaller volume of a user device. In this embodiment, the phase-controlling circuit 150 is disposed at a proximal end of the folded arm 104, the proximal end being the nearest to the ground plane 140.

In one embodiment, the antenna structure is configured to operate at a resonant frequency in a first state. The phase-controlling circuit 150 is configured to introduce a phase shift (e.g., electrical phase delay or an electrical phase advance) in the antenna structure to change the resonant frequency of the antenna structure to a second resonant frequency in a second state. In one embodiment, the phase-controlling circuit 150 is configured to introduce an inductance to shift down the resonant frequency to the second resonant frequency in the second state. In another embodiment, the phase-controlling circuit 150 is configured to introduce a capacitance to shift up the resonant frequency to the second resonant frequency in the second state. In another embodiment, the phase-controlling circuit is configured to introduce an inductance to shift down the resonant frequency to the second resonant frequency in the second state and introduce a capacitance to shift up the resonant frequency to the second resonant frequency in a third state.

In FIG. 1, the ground is represented as the radiation ground plane 140. The ground plane 140 may be a metal frame of the electronic device. The ground plane 140 may be a system ground or one of multiple grounds of the user device. The RF feed 142 may be a feed line connector that couples the phase-controlled antenna 100 to the feed line (also referred to as the transmission lines), which is a physical connection that carries the RF signals to and/or from the phase-controlled antenna 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the folded monopole structure 101. The folded monopole structure 101 is coupled to the ground plane 140 via the phase-controlling circuit 150. For example, the folded monopole structure 101 is coupled a grounding path that is coupled to the phase-control circuit 150, which selects a path based on a state of the phase-controlled antenna 100. Alternatively, other configurations of the phase-controlled antenna 100 are possible as would be appreciated by one of ordinary skill in the art having the benefit of this disclosure.

In one embodiment, the phase-controlled antenna 100 is disposed on an antenna carrier (not illustrated in FIG. 1), such as a dielectric carrier of the electronic device. The antenna carrier may be any non-conductive material, such as dielectric material, upon which the conductive material of the phase-controlled antenna 100 can be disposed without making electrical contact with other metal of the electronic device. In another embodiment, the phase-controlled antenna 100 is disposed on, within, or in connection with a circuit board, such as a printed circuit board (PCB). In one embodiment, the ground plane 140 may be a metal chassis of a circuit board. Alternatively, the phase-controlled antenna 100 may be disposed on other components of the electronic device or within the electronic device as would be appreciated by one of ordinary skill in the art having the benefit of this disclosure. It should be noted that the phase-controlled antenna 100 illustrated in FIG. 1 is a two-dimensional (2D) structure. However, as described herein, the phase-controlled antenna 100 may include three-dimensional (3D) structures, as well as other variations than those depicted in FIG. 1.

During operation, the phase-controlling circuit 150 is programmable to introduce a phase shift (e.g., an electrical phase delay or an electrical phase advance) in the antenna structure to change the resonant frequency of the antenna structure to a second resonant frequency in a second state. In the first state, the antenna structure is configured to operate at the resonant frequency. The phase-controlling circuit 150 can be used to adjust the resonant frequency of the antenna structure. The phase-controlling circuit 150 can be used over individual bands so that the peak efficiency is adjusted for the individual band, as illustrated and described below with respect to FIG. 9 & FIG. 10. As described herein, an electrical phase advance or electrical phase delay can be introduced to change a natural resonance of the antenna structure. For example, inductors or ferrite devices can be switched into the ground path by the phase-controlling circuit 150 to introduce an inductance (jwL) to shift down the resonant frequency (i.e., decrease the resonant frequency). The introduction of the inductance introduces an electrical phase advance in the antenna structure to shift down the resonant frequency. A capacitor can be switched into the ground path by the phase-controlling circuit 150 to induce a capacitance (1/jwC) to shift up the resonant frequency (increase the resonant frequency). The introduction of the capacitance introduces an electrical phase delay in the antenna structure to shift down the resonant frequency. Alternatively, a phase-shifter could be used to synthesize phase advance and phase delay with more flexibility and possible greater granularity of adjustments. Phase shifters are a special class of phase controlling circuits that receives one or more input control signals to provide a controllable phase shift of the RF signal.

As described herein, in a constrained radiation space (low and thin profiles for mobile devices), antenna engineers face challenges to enlarge the bandwidth for the frequency bands between 700 MHz to 960 MHz, such as for LTE band to GSM 850 or GSM 900 bands, with sufficient antenna efficiency. The phase-controlling circuit 150 can be used to tune the peak antenna efficiency for an individual band.

In one embodiment, a control unit is coupled to the phase-controlling circuit 150 to control the phase of the antenna structure. The control unit may implement a state machine to change between the different states of the antenna structure. For example, in one embodiment, the antenna structure can have four states: 1) state 1 in which a small inductor (e.g., less than 10 nH) is switched into the ground path; 2) state 2 in which the ground path is directly connected to the ground nodes (without any phase shifting); 3) state 3 in which a first capacitor (e.g., 18 pF) is switched into the ground path; and 4) state 4 in which a second capacitor (e.g., 6.8 pF) is switched into the ground path. In another embodiment, the control unit can determine a specific phase shift and use a phase-shifter coupled in the ground path to set the phase shift of the antenna structure.

In one embodiment, the folded monopole structure 101 is configured to radiate electromagnetic energy in a first frequency range (e.g., low-band) and the second folded monopole structure 125 is configured to radiate electromagnetic energy in a second frequency range (e.g., high-band), which is higher than the first frequency range. In one embodiment, the first frequency range is between approximately 700 MHz to approximately 960 MHz and the second frequency range is between approximately 1.7 GHz to approximately 2.2 GHz. In another embodiment, the first frequency range is between approximately 700 MHz to approximately 960 MHz and the second frequency range is between approximately 1.7 GHz to approximately 2.7 GHz. The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes, for example, a first high-band mode and a second high-band mode. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein also provide a phase-controlled antenna with increased bandwidth in a size that is conducive to being used in a user device. The terms "first," "second," "third," "fourth," etc., as used herein, are meant as labels to distinguish among different elements and may not necessarily have an ordinal meaning according to their numerical designation.

The phase-controlled antenna 100 may have various dimensions based on the various design factors. In one embodiment, the phase-controlled antenna 100 has an overall height (h), an overall width (W), and an overall depth (d). The overall height (h) may vary, but, in one embodiment, is about 8 mm. The overall width (W) may vary, but, in one embodiment, is about 42 mm. The overall depth may vary, but, in one embodiment, is about 0 mm since the phase-controlled antenna 100 is 2D. In one embodiment, the overall depth may be 4 mm and portions of the phase-controlled antenna 100 can be wrapped around different sides of the antenna carrier.

Strong resonances are not easily achieved within a compact space within user devices, especially within the spaces on smart phones and tablets. The structure of the phase-controlled antenna 100 provides strong resonances at a first frequency range of approximately 700 MHz to approximately 960 MHz and at a second frequency range of approximately 1.7 GHz to approximately 2.2 GHz. Alternatively, the structure of the phase-controlled antenna 100 provides strong resonances at a first frequency range of approximately 700 MHz to approximately 960 MHz and at a second frequency range of approximately 1.7 GHz to approximately 2.7 GHz. These resonances can be operated in separate modes or may be operated simultaneously. Strong resonances, as used herein, refer to a significant return loss at those frequency bands, which is better for impedance matching to 50-ohm systems. These multiple strong resonances can provide an improved antenna design as compared to conventional designs.

Figure 2:
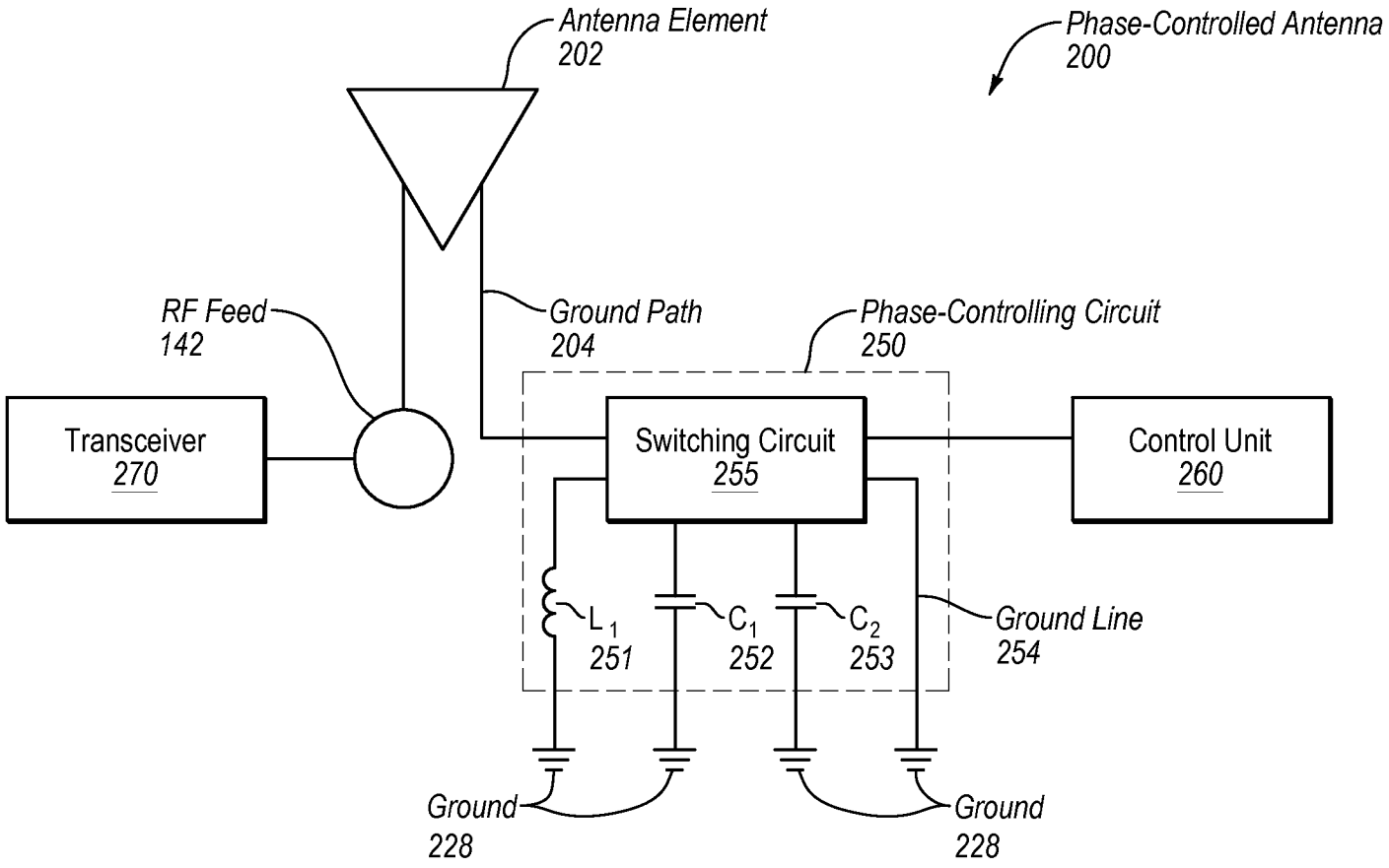
FIG. 2 is a circuit diagram of a phase-controlled antenna according to one embodiment.

FIG. 2 is a circuit diagram of a phase-controlled antenna 200 according to one embodiment. The phase-controlled antenna 200 includes an antenna element 202 coupled to the RF feed 142. The RF feed 142 is coupled to a transceiver 270. The transceiver 270 is configured to drive the antenna element 202 to radiate electromagnetic energy to communicate with another device. The antenna element 202 is coupled to a phase-controlling circuit 250 via a ground path 204. The phase-controlling circuit 250 is controlled by a control unit 260. The control unit 260 may provide digital or analog signals to the switching circuit 255 to control the switching to the different paths to the ground node 228 based on a state of the phase-controlled antenna 200. The control unit 260 may be part of a wireless mode, the transceiver 270, a processing element, a processing device or the like. The phase-controlling circuit 250 includes a switching circuit 255, a first inductor 251, a first capacitor 252, a second capacitor 253 and a ground line 254. The switching circuit 255 is configured to receive one or more control signals from the control unit 260 to switch between the paths between the ground path 204 and a ground node 228. The ground node 228 may be the same ground node as the ground plane 140. The ground node 228 may be a grounding point on a printed circuit, a grounding point in the user device, or any other metal connection that is the same ground potential as the ground plane 140. The ground node 228 is used by the switching circuit 255 to connect the different paths to ground. In one embodiment, the switching circuit 255 includes a single pole, triple throw (SPTT) switch coupled to the ground path 204 on the input terminal and to first inductor 251 on a first output terminal, to the first capacitor 252 on a second output terminal and to the ground line 254 on a third output terminal. Alternatively, the switching circuit 255 may include multiple switches to switch in different combinations of components to change the phase of the antenna element 202 or to not change the phase (as in the case of coupling the ground path 204 to the ground line 254).

Figure 3:
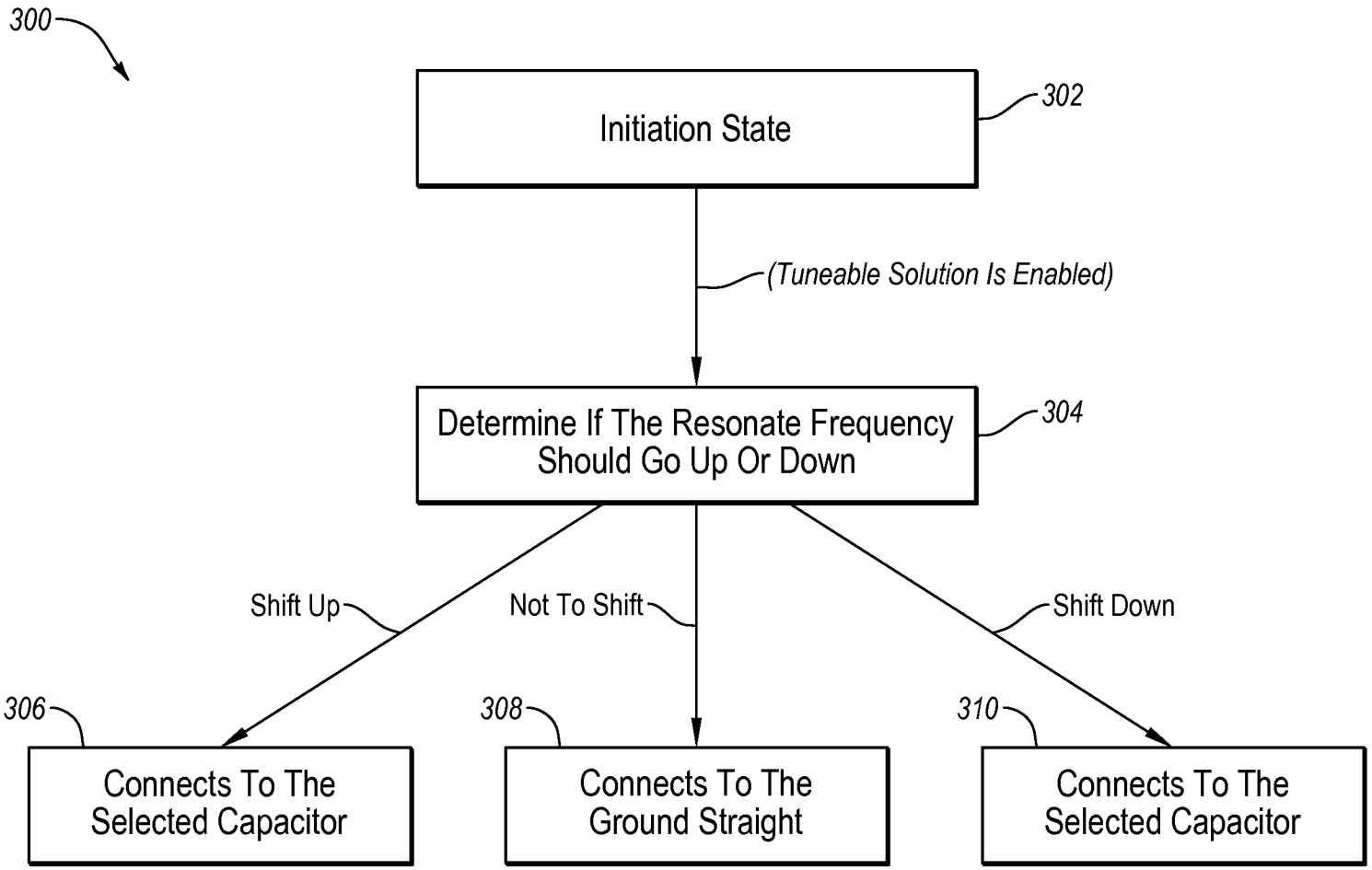
FIG. 3 is a flow diagram of a method of shifting a resonate frequency of the phase-controlled antenna of FIG. 2 according to one embodiment.

FIG. 3 is a flow diagram of a method 300 of shifting a resonate frequency of the phase-controlled antenna 200 of FIG. 2 according to one embodiment. The method 300 begins in an initiation state (block 302) in which a tunable solution is enabled. That is the phase-controlling circuit is enabled to permit the tuning of the resonant frequency of the phase-controlled antenna 200. The method 300 then determines whether the resonant frequency should be changed (e.g., moved up or down) (block 304). In view of this determination, the method 300 can 1) shift up; 2) shift down; or 3) stay the same. If the determination is to shift up, the method 300 connects the selected capacitor to the ground path of the phase-controlled antenna 200 (block 306). If the determination is to shift down, the method 300 connects the selected inductor to the ground path of the phase-controlled antenna 200 (block 210). If the determination is to not shift up or down, the method 300 connects the ground line to the ground path of the phase-controlled antenna 200 (block 308). The method 300 can be repeated when the determination is enabled again or it is determined that the resonant frequency needs to be changed again.

Figure 4:
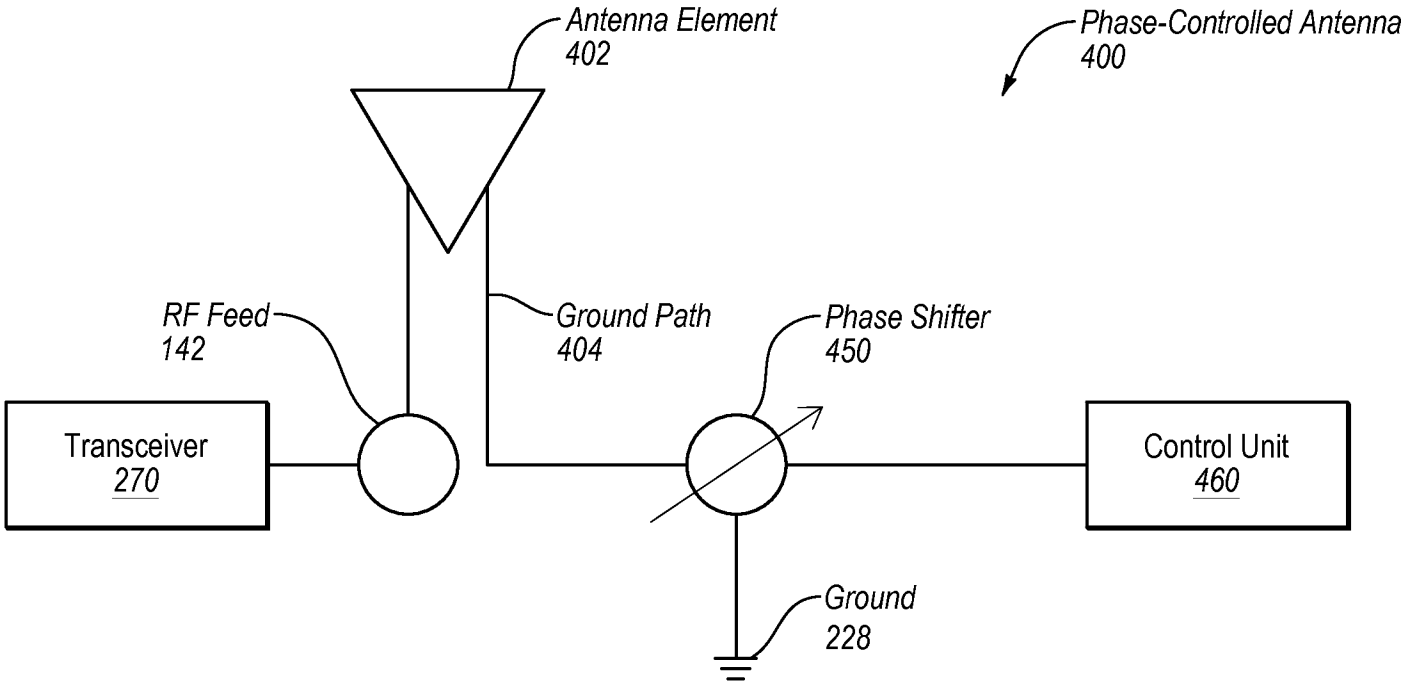
FIG. 4 is a circuit diagram of a phase-controlled antenna according to another embodiment.

FIG. 4 is a circuit diagram of a phase-controlled antenna 400 according to another embodiment. The phase-controlled antenna 400 includes an antenna element 402 coupled to the RF feed 142, which is coupled to the transceiver 270. The transceiver 270 is configured to drive the antenna element 402 to radiate electromagnetic energy to communicate with another device. The antenna element 402 is coupled to a phase-controlling circuit 450 via a ground path 404. The phase-controlling circuit 450 is controlled by a control unit 460. The control unit 460 may control the phase-controlling circuit 450 using a voltage control signals. The control unit 260 may provide digital or analog signals to the phase-controlling circuit 450 to adjust the phase to change the resonant frequency. The control unit 460 may be part of a wireless mode, the transceiver 270, a processing element, a processing device or the like. In this embodiment, the phase-controlling circuit 450 includes a phase shifter. The phase shifter can be voltage controlled to change the phase accordingly. For example, the phase-shifter can be controlled to shift up the resonant frequency or shift down the resonant frequency. The phase-shifter can also be controlled so that no phase shift is introduced.

Figure 5:
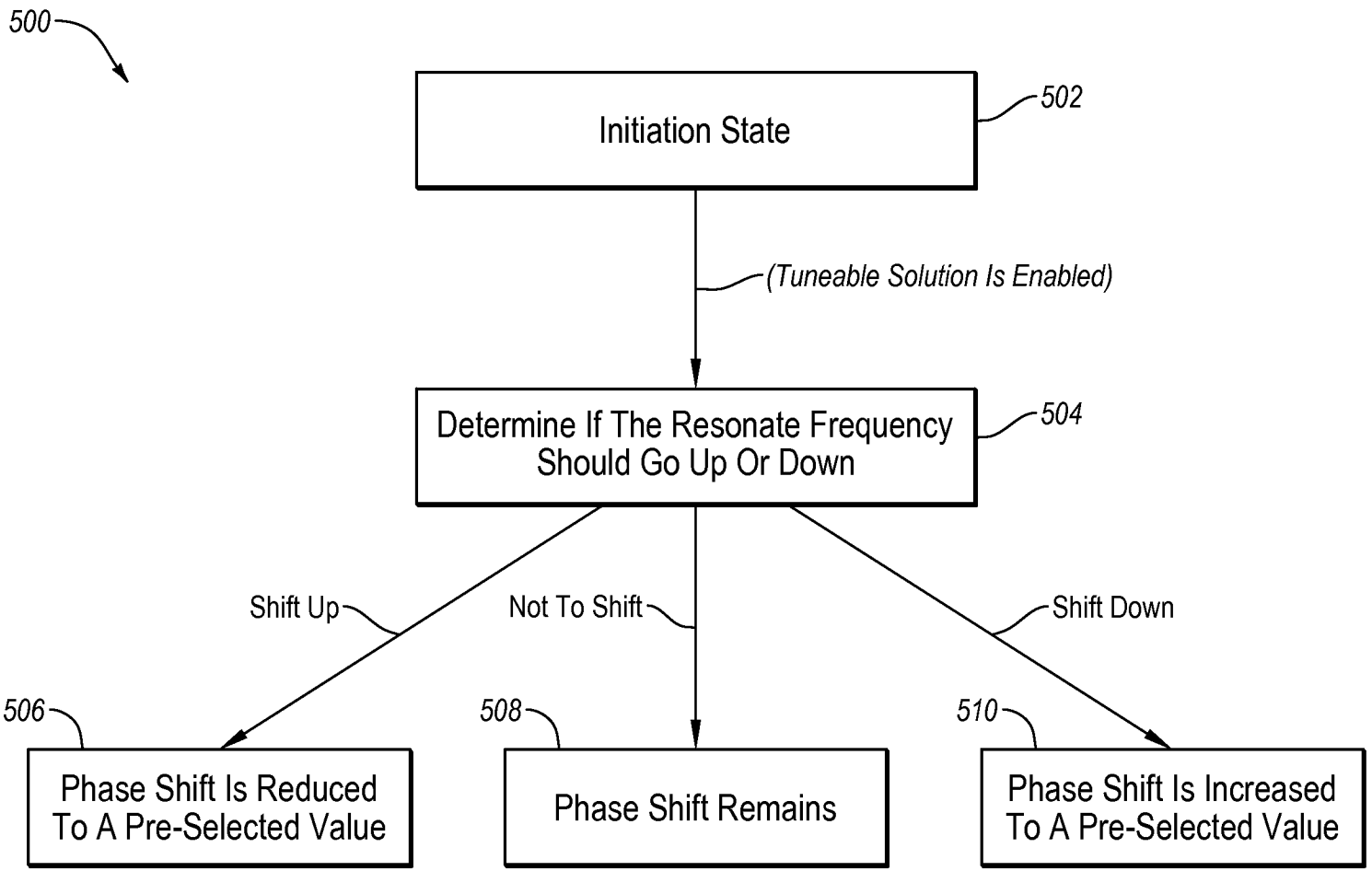
FIG. 5 is a flow diagram of a method of shifting a resonate frequency of the phase-controlled antenna of FIG. 4 according to one embodiment.

FIG. 5 is a flow diagram of a method 500 of shifting a resonate frequency of the phase-controlled antenna of FIG. 4 according to one embodiment. The method 500 begins in an initiation state (block 502) in which a tunable solution is enabled. That is the phase-controlling circuit is enabled to permit the tuning of the resonant frequency of the phase-controlled antenna 400. The method 500 then determines whether the resonant frequency should be changed (e.g., moved up or down) (block 504). In view of this determination, the method 500 can 1) shift up; 2) shift down; or 3) stay the same. If the determination is to shift up, the method 500 reduces a phase shift of a phase-shifter to a first value (block 506). This first value can be pre-selected by a developer, a manufacturer or an operator of the electronic device containing the phase-controlled antenna 400. If the determination is to shift down, the method 500 increases a phase shift of the phase-shifter to a second value (block 510). This second value may also be pre-selected. If the determination is to not shift up or down, the method 500 keeps the phase shift of the phase-shifter the same (block 508). The method 500 can be repeated when the determination is enabled again or it is determined that the resonant frequency needs to be changed again.

Figure 6:
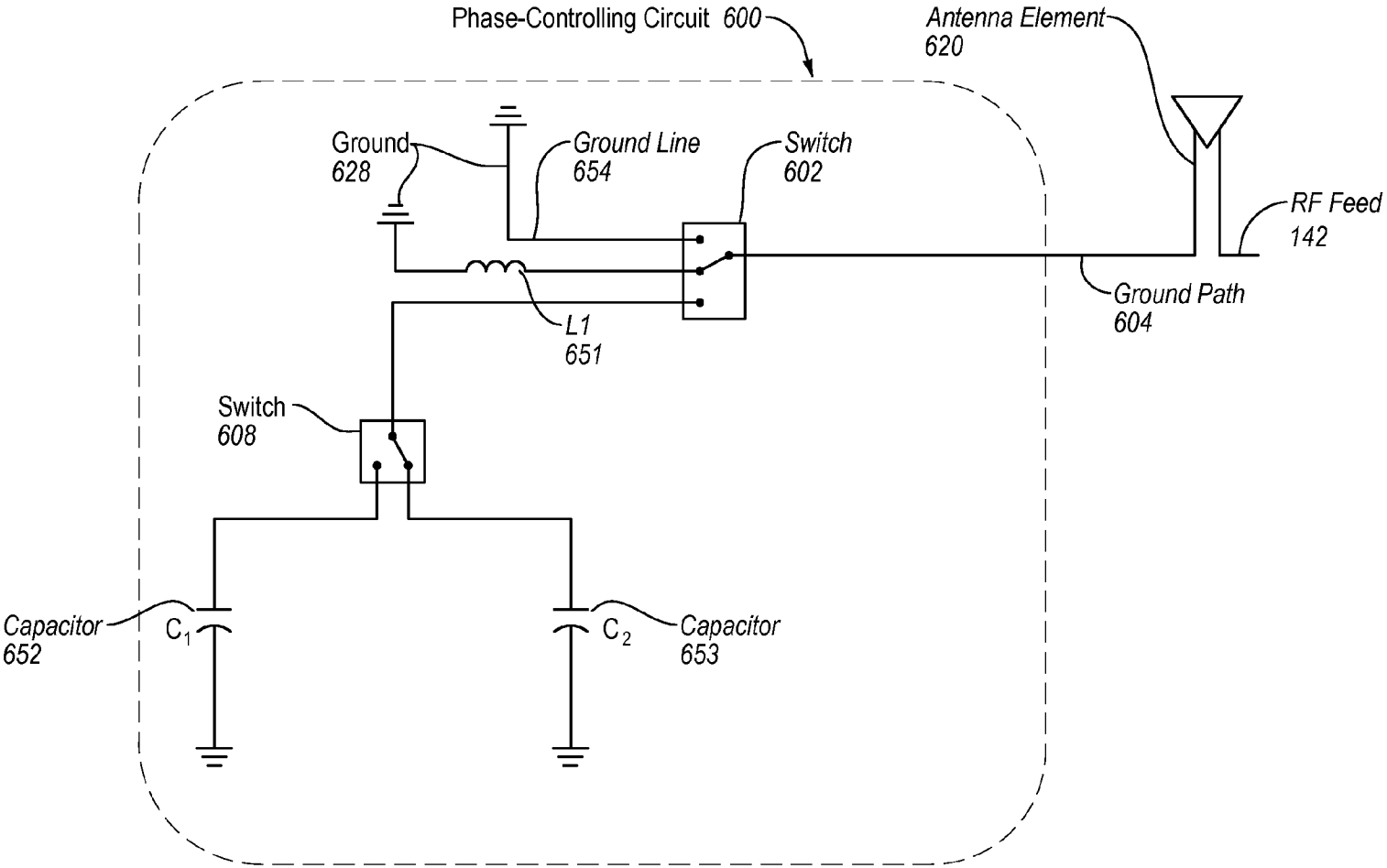
FIG. 6 is a circuit diagram of a phase-controlling circuit according to another embodiment.

FIG. 6 is a circuit diagram of a phase-controlling circuit 600 according to another embodiment. The phase-controlling circuit 600 includes multiple tunable matching networks that can be switched in between a terminal 642, which is coupled to a ground path 604 of an antenna element 620, and a ground node 628. The antenna element 620 is also coupled to the RF feed 142. These tunable matching networks can be switched in parallel or in series with the terminal 642. Different combinations of these tunable matching networks can be switched in and out to achieve different phases for the antenna element 220. In the depicted embodiment, the phase-controlling circuit 600 includes a first switch 602 coupled to the terminal 642 in a first input, and coupled to a ground line 654 at a first output, to an inductor 651 ($L_1$) at a second output, and to a second switch 608 at a third output. The second switch 608 is coupled to a first capacitor 652 ($C_1$) at a first output and to a second capacitor 653 ($C_2$) at a second output. In some embodiments, the first and second capacitors can be tunable capacitors. That is the capacitors can be variable capacitors with varying capacitance values. These tunable capacitors can also be controlled via the control unit. The first capacitor 652 ($C_1$) and the second capacitor 653 ($C_2$) are coupled in series to the ground node 628. The first switch 602 and second switch 608 can be controlled by the control unit, which may be part of a processing element, such as a wireless modem, a processing device, a controller or the like. A processing device, such as described herein, can be used to control the switches 602 and 608. For example, the processing device can use control signals to control the state of the switches 602 and 608. Alternatively, other circuits can be used for the phase-controlling circuit 600 to switch between the different configurations. Similarly, the processing element may control the first tunable capacitors to change the capacitance value being switched into the ground path 604. This can be done in connection with the control of the first switch 602 and the second switch 608. In effect, the switches and the passive components can be programmed into different configurations and to have different capacitance values or inductance values to vary the phase of the antenna element 620. The switches and passive components can also be used to connect the ground path 604 to the ground node 628 without any adjustment in the phase. In other embodiments, additional passive components can be used to provide additional configurations to change the phase of the antenna element 620. In these embodiments, tunable capacitors are considered passive components although there values can be varied. In other embodiments, the phase-controlling circuit 600 may use active components in addition to, or in place of, the passive components. For example, the phase-controlling circuit 600 can use a phase-shifter to shift the phase up or down, or to remain the same.

In one embodiment, the phase-controlling circuit 600 can be used for the phase-controlling circuit 150, the phase-controlling circuit 250, the phase-controlling circuit 705 described below with respect to FIG. 7 or other phase-controlling circuits.

Semiconductor phase shifters can be small size and relatively low power consumption compared to ferrite devices. There are many possible circuit topologies, using diode or FET switches in various configurations. In one embodiment, the phase shifter may be a high-pass/low-pass network phase shifter. In principle, any variable reactance in series or shunt across a transmission line can be used to introduce phase shifter. A high-pass/low-pass phase shifter network uses discrete capacitors and inductors. The phase shifter may include PIN diodes or MESFETs can be used to implement the switches, such as single-pole, double throw switches. In the high-pass configuration, a relative delay is realized. In the opposite configuration, with all SPDT switches toggled, the low-pass circuit represents a relative phase advance. In another embodiment, the phase shifter can be a loaded line phase shifter. Ideally, reactive loads, spaced one-quarter wavelength apart, are shunted across a transmission line to affect phase shifter. If a susceptance is capacitive, the phase velocity is decreased. If the susceptance is inductive, the phase velocity is increased. In another embodiment, the phase shifter can be a switched line phase shifter. In a switched line phase shifter, SPDT switches may be used to toggle between transmission lines with different path lengths. Alternatively, other types of phase shifters can be used.

Figure 7:
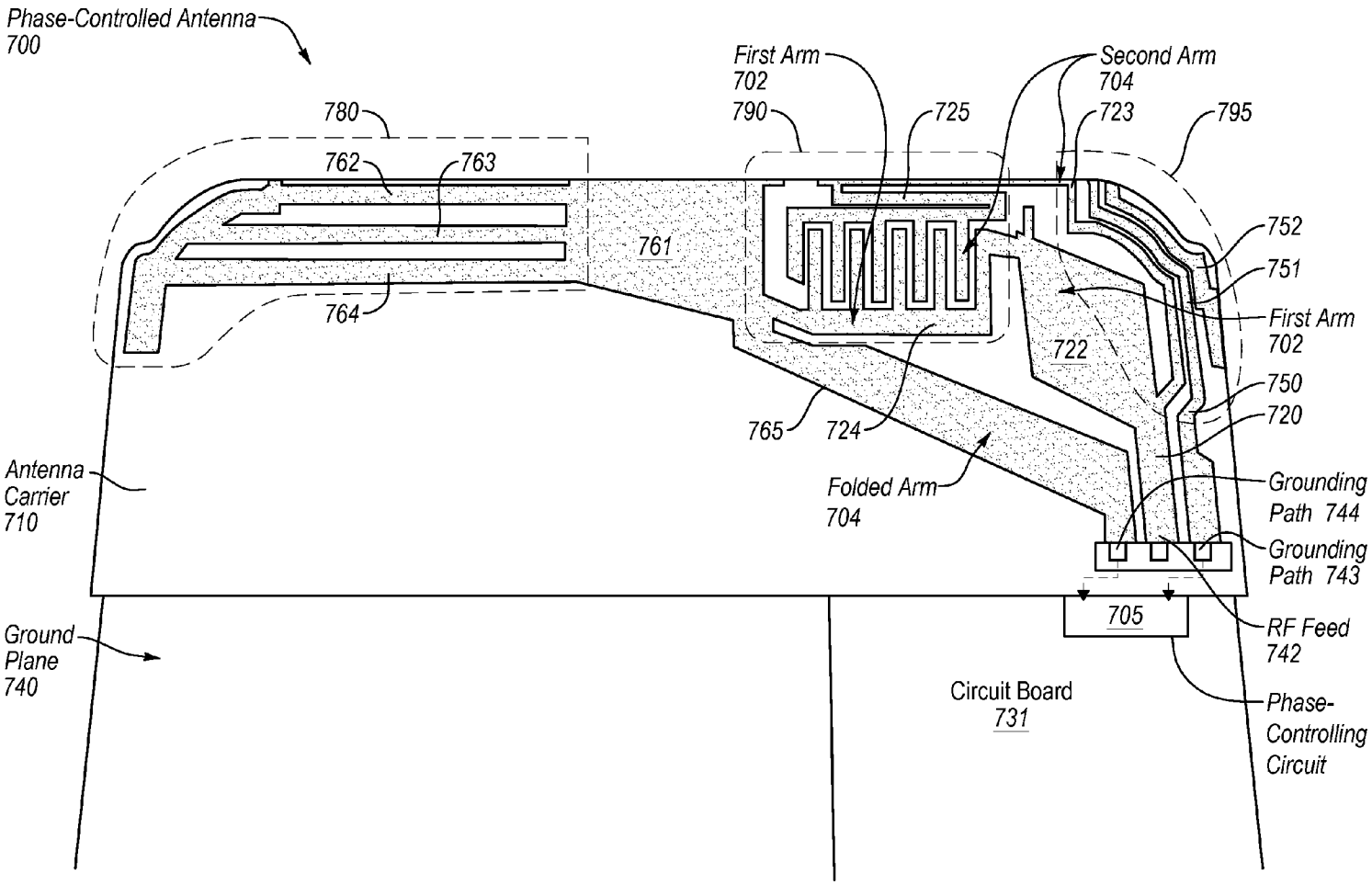
FIG. 7 illustrates another embodiment of a phase-controlled, multi-mode wideband antenna coupled to a phase-controlling circuit.

FIG. 7 illustrates another embodiment of a phase-controlled, multi-mode wideband antenna 700 coupled to a phase-controlling circuit. The phase-controlled, multi-mode wideband antenna 700 includes a folded monopole structure 720 including a first arm 702, a folded arm 704, and a second arm 706 (e.g., second monopole element 723 and coupler section 725) that splits off of the first arm 702. The phase-controlled, multi-mode wideband antenna 700 also includes a parasitic ground element 750

In this embodiment, the phase-controlled, multi-mode wideband antenna 700 is fed at the single RF feed 742 at the folded monopole structure 720 and the parasitic ground element 750 is a parasitic element. A parasitic element is an element of the phase-controlled, multi-mode wideband antenna 700 that is not driven directly by the single RF feed 742. Rather, the single RF feed 742 directly drives another element of the phase-controlled multi-mode wideband antenna 700 (e.g., the folded monopole structure 720), which parasitically induces a current on the parasitic element. In particular, by directly inducing current on the other element by the single RF feed 742, the directly-fed element radiates electromagnetic energy, which causes another current on the parasitic element to also radiate electromagnetic energy, in multiple resonant modes. In the depicted embodiment, the parasitic ground element 750 is parasitic because it is physically separated from the folded monopole structure 720 that is driven at the single RF feed 742. The driven folded monopole structure 720 parasitically excites the current flow of the parasitic ground element 750. In one embodiment, the parasitic ground element 750 and folded monopole structure 720 can be physically separated by a gap. Alternatively, other antenna configurations may be used to include a driven element and a parasitic element. The dimensions of the folded monopole structure 720, folded monopole structure 720, and the parasitic ground element 750 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

In FIG. 7, the ground is represented as the radiation ground plane 740. The ground plane 740 may be a metal frame of the user device. The ground plane 740 may be a system ground or one of multiple grounds of the user device. The RF feed 742 may be a feed line connector that couples the phase-controlled, multi-mode wideband antenna 700 to a feed line (also referred to as the transmission line), which is a physical connection that carriers the RF signal to and/or from the phase-controlled, multi-mode wideband antenna 700. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to folded monopole structure 720, but is not conductively connected to the parasitic ground element 750. However, the folded monopole structure 720 is configured to operate as a feeding structure to the parasitic ground element 750. That is the first element parasitically induces current at the parasitic ground element 750 as described above.

In one embodiment, the phase-controlled, multi-mode wideband antenna 700 is disposed on an antenna carrier 740, such as a dielectric carrier of the user device. The antenna carrier 740 may be any non-conductive material, such as dielectric material, upon which the conductive material of the phase-controlled, multi-mode wideband antenna 700 can be disposed without making electrical contact with other metal of the user device. In another embodiment, the phase-controlled, multi-mode wideband antenna 700 is disposed on, within, or in connection with a circuit board 731, such as a printed circuit board (PCB). In the depicted embodiment, a circuit board 731 is disposed on the ground plane 740, and the ground plane 740 may be a metal chassis. Alternatively, the phase-controlled, multi-mode wideband antenna 700 may be disposed on other components of the user device or within the user device as would be appreciated by one of ordinary skill in the art having the benefit of this disclosure. It should be noted that the phase-controlled, multi-mode wideband antenna 700 illustrated in FIG. 7 is a three-dimensional (3D) structure. However, as described herein, the phase-controlled, multi-mode wideband antenna 700 may include two-dimensional (2D) structures, as well as other variations than those depicted in FIG. 7.

Using the folded monopole structure 720 and the parasitic ground element 750, the phase-controlled, multi-mode wideband antenna 700 can create multiple resonant modes using the single RF feed 742, such as four resonant modes. In one embodiment, the phase-controlled, multi-mode wideband antenna 700 can be configured to create a resonant mode for LTE 700 band plus the penta-band. In telecommunications, the terms multi-band, dual-band, tri-band, quad-band, and penta-band refer to a device, such as the user device described herein, supporting multiple RF bands used for communication. In other embodiments, the antennas can be designed to cover an eight-band LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690 MHz operation. In the user device context, the purpose of doing so is to support roaming between different regions whose infrastructure cannot support mobile services in the same frequency range. These frequency bands may be Universal Mobile Telecommunication Systems (UMTS) frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1×RTT), evaluation data optimized (EVDO), high-speed downlink packet access (HSDPA), WiFi, WiMax, etc.

In the depicted embodiment, the phase-controlled, multi-mode monopole antenna 700 includes a folded monopole structure 720 and a parasitic ground element 750. The folded monopole structure 720 is coupled to the single RF feed 142. The folded monopole structure includes the folded arm 704 that is coupled to grounding path 744, which is coupled to the phase-controlling circuit 705 that provide different paths to the ground plane 740. The parasitic ground element 750 is coupled to grounding path 743, which may also be coupled to the phase-controlling circuit 705, a second phase-controlling circuit (not illustrated) or the ground plane 740 directly.

The folded monopole structure 720 further includes a middle portion 761 and an arm portion 780 with three parallel traces 762, 763, 764. In other embodiments, two or more parallel traces may be used. The middle portion 761 is coupled to a distal end of the folded arm 704 and the first arm 702 and the three parallel traces 762-764 extend out from the middle portion 761 at a distal end of the folded monopole structure 720. The distal end is the end that is farthest away from the grounding path 744. In one embodiment, the middle portion 761 has a rectangular shape and the three parallel traces 762-764 extend out a side of the rectangular shape, and the first arm 702 is coupled at an opposite side, such as at the lower right corner as depicted in FIG. 7. The three parallel traces 762-764 form two floating pieces. In other embodiments, two or more traces can be used. Also, in other embodiments, the traces do not necessarily need to join again at the distal end as depicted in FIG. 7. In the depicted embodiment, the arm portion 780 also includes a stub that extends towards the ground plane 740 to add additional length to the folded monopole structure 720. Also, the folded monopole structure 720 also includes additional arms that extend to the topside of the antenna carrier 740 (not illustrated).

The folded monopole structure 720 includes three arms. The first arm 702 includes a feed trace, a widened section 722, having a diamond shape and a first coupler section 724. The widened section 722 is wider than the feed trace and the first coupler section 724. The feed trace extends from the RF feed 742 towards a first end of the widened section 722 and the first coupler section 724 extends from a second end of the widened section 722 to where the first arm 702 is conductively connected to the distal end of the folded arm 704. The phrase "conductively connected," as used herein, indicates that the two antenna elements have a connection between them that allows for conduction of current. For example, one element can be physically connected to the other element and this physical connection allows current to flow between the two antenna elements. In other contexts, for purposes of comparison, two elements can be coupled or form a "coupling," without being physically connected. For example, two antenna elements can be disposed in a way to form a capacitive coupling between the two antenna elements or an inductive coupling between the two antenna elements. The second arm 706 of the folded monopole structure 720 includes a second monopole element 723 and a second coupler section 725. The second monopole element 723 extends from the feed trace and the second coupler section 725 extends from a distal end of the second monopole element 723. The first coupler section 124 and the second coupler section 725 are disposed to form a coupling 790 between the first arm 702 and the second arm 706. The second monopole element 723 extends to the topside of the antenna carrier and then returns back to the front side of the antenna carrier 740 where the second coupler section 725 is disposed. It should also be noted that other shapes for the folded monopole structure 720 are possible. For example, the second monopole element 723 can have various bends, such as to accommodate placement of other components, such as a speakers, microphones, USB ports. Also, the folded monopole structure 720 includes a stub that extends the second side of the widened section 722. Also, as described below, the second monopole element 723 extends along a portion of the parasitic ground element 750 to form a coupling 795 between the folded monopole structure 720 and the parasitic ground element 750.

The parasitic ground element 750 is a folded monopole element. The folded monopole element includes a first portion 751 that is laid out at least partially in parallel to a portion of the second monopole element 723 in a first direction until a first fold (on a topside of the antenna carrier 740) and a second portion 752 that folds back towards the ground plane 740 from the first fold and is laid out at least partially in parallel to the first portion 751 for a specified distance from the first fold. Alternatively, the first portion 751 and second portion 752 can be disposed next to each other and the second monopole element 723 in other configurations as would be appreciated by one of ordinary skill in the art. It should also be noted that a "fold" refers to a bend, a corner or other change in direction of the antenna element. For example, the fold may be where one segment of an antenna element changes direction in the same plane or in a different plane. Typically, folds in antennas can be used to fit the entire length of the antenna within a smaller volume of a user device.

As described above, the first portion 751 and the monopole element 723 of the folded monopole structure 720 form the coupling 795. In the depicted embodiment, the parasitic ground element 750 is a folded monopole element, but could be another type of antenna and may have a different shape as would be appreciated by one of ordinary skill in the art having the benefit of this disclosure.

Strong resonances are not easily achieved within a compact space within user devices, especially with the spaces on smart phones and tablets. The structure of the phase-controlled, multi-mode wideband antenna 700 provides multiple strong resonances at 700 MHz to 960 MHz and 1.7 GHz to 2.2 GHz. The couplings 790, 795 (illustrated in FIG. 7) can be designed to contribute to these resonances. Strong resonances, as used herein, refer to a significant return loss at those frequency bands, which is better for impedance matching to 50-ohm systems. These multiple strong resonances can provide an improved antenna design as compared to conventional designs.

Figure 8:
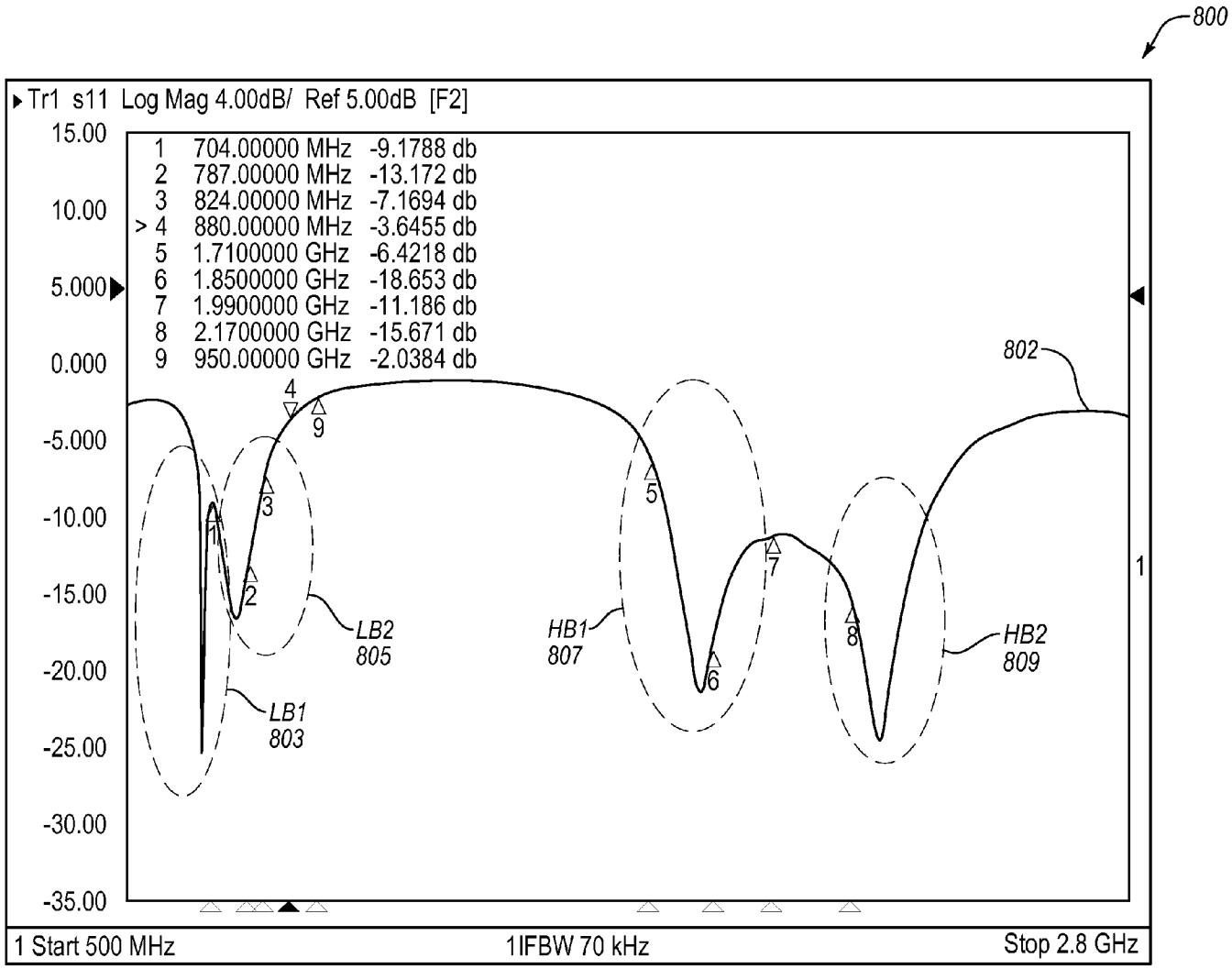
FIG. 8 is a graph of measured reflection coefficient of the phase-controlled, multi-mode wideband antenna of FIG. 7 according to one embodiment.

FIG. 8 is a graph 800 of measured reflection coefficient of the phase-controlled, multi-mode wideband antenna 700 of FIG. 7 according to one embodiment. The graph 800 shows the measured reflection coefficient (also referred to S-parameter or |S11|) 802 of the structure of the phase-controlled, multi-mode wideband antenna 700 of FIG. 7. The phase-controlled, multi-mode wideband antenna 700 uses a single RF feed for the same frequency bands between 700 MHz and 960 MHz and 1.7 GHz to 2.2 GHz, but can be more easily integrated into the user device. The phase-controlled, multi-mode wideband antenna 700 covers approximately 700 MHz to 960 MHz in a low-band and 1.71 GHz to 2.2 GHz in a high-band. The phase-controlled, multi-mode wideband antenna 700 provides four resonant modes, including a LB1 803, LB2 805, HB1 807 and HB2 809. That is the phase-controlled, multi-mode wideband antenna 700 decreases the reflection coefficient at the corresponding frequencies to create or form LB1 803, LB2 805, HB1 807 and HB2 809. The LB1 803 is approximately at 700 MHz. The LB2 805 is approximately at 1 GHz. The HB1 807 is approximately at 1.5 GHz. The HB2 809 is approximately at 2.2 GHz. As described herein, other resonant modes may be achieved. Also, the two sets of low and high resonances can be synthesized and combined to meet LTE and penta-band bandwidths. Alternatively, the two sets can be synthesized and combined to meet LTE and quad- or tri-band bandwidths as well.

Low profile multi-mode antennas are especially attractive to compact, conformal user devices, such as mobile devices. However, as fundamental antenna theory states the antenna bandwidth is proportional to the effective radiation volume, the antenna performance (e.g., bandwidth and efficiency), and the quality factor is degraded by the constrained space given by the user device. This is expressed in Chu's limit as follows:

$$Qualityfactor \sim \frac{1}{B.W.} \sim 1 \Big/ r^3$$

In other words, the size constraint could radically change the antenna design concept and methodology. For example, the embodiments described below describe 3D structures that can improve the quality factor of the antenna design. Embodiments of the 3D structures provide a compact designed 3D structure to cope with the compact user device environment.

In the depicted embodiment, there are four resonate modes created by the folded monopole structure 720 and the parasitic ground element 750. In one embodiment, the folded monopole structure 720 provides a first resonant mode and a second resonant mode. More specifically, the folded monopole structure 720 decreases a reflection coefficient at certain frequencies to create the first resonant mode and at the second resonant mode. In particular, the inductive coupling 790, formed by the first coupler section 724 and the second coupler section 725, and the second monopole element 723 that extends back to the RF feed 742 contribute to the first resonant mode. Also, the arm portion 780 with the three parallel traces 762-764 contributes to the second resonant mode. The parasitic ground element 750 is configured to provide a third resonant mode. More specifically, the parasitic ground element 750 decreases the reflection coefficient at the third resonant mode. A fourth resonant mode can be created by the third harmonic of the folded monopole structure 720. In particular, the widened middle portion 761 of the folded monopole structure 720 contributes to the third harmonic. Also, the inductive coupling 790 formed by the first coupler section 724 and the second coupler section 725 may also contribute to the fourth resonant mode. In one embodiment, the first resonant mode 803 is in a range between 680 MHz and 705 MHz, the second resonant mode 805 is in a range between 700 MHz to 950 MHz, the third resonant mode 807 is in a range between 1.71 GHz and 2 GHz, and the fourth resonant mode 809 is in a range between 1.91 GHz and 2.43 GHz. The terms "first," "second," "third," "fourth," etc., as used herein, are meant as labels to distinguish among different resonant modes and may not necessarily have an ordinal meaning according to their numerical designation.

In another embodiment, the folded monopole structure 720 and the parasitic ground element 750 can be configured to create three resonant modes or more than four resonant modes. In one embodiment, the phase-controlled, multi-mode wideband antenna 700 can be designed to operate in the following target bands: 1) Verizon LTE band: 746 to 787 MHz; 2) US 850 (band 5): 824 to 894 MHz; 3) GSM900 (band 8): 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about −5 dB bandwidth (BW). Alternatively, the phase-controlled, multi-mode wideband antenna 700 can be designed to operate in different combinations of frequency bands as would be appreciated by one of ordinary skill in the art having the benefit of this disclosure.

Figure 9:
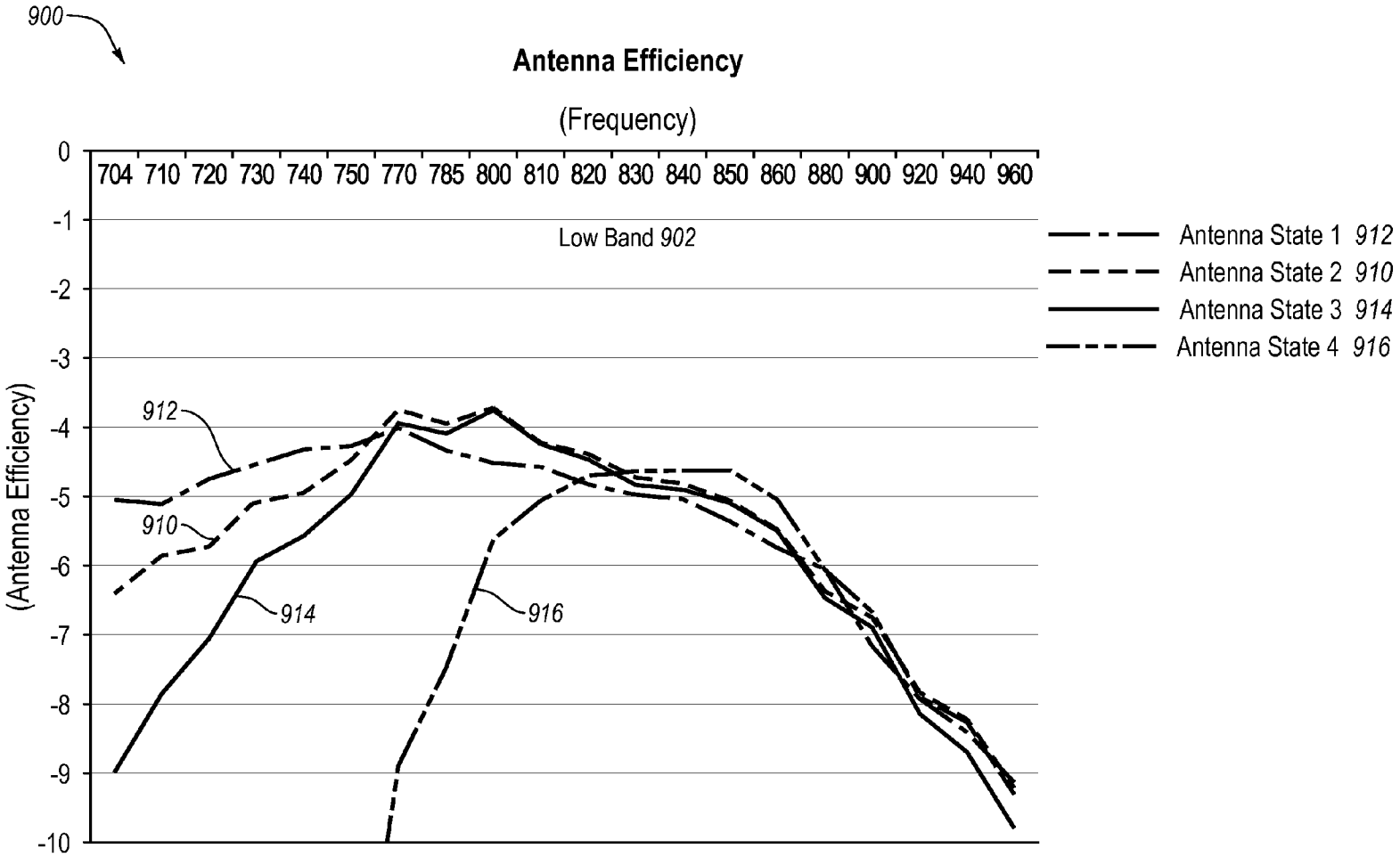
FIG. 9 is a graph of measured efficiency of the phase-controlled, multi-mode wideband antenna of FIG. 7 in a low band according to one embodiment.

FIG. 9 is a graph 900 of measured efficiency of the phase-controlled, multi-mode wideband antenna 700 of FIG. 7 in a low band 902 according to one embodiment. The graph 900 illustrates total efficiencies 910-916 of the resonant frequency of the antenna 700 when tuned by the phase-controlling circuit in four different states. In particular, the total efficiency 910 of the antenna 700 is when no phase delay or phase advance is added (state 2) by the phase-controlling circuit. The total efficiency 912 is when of the resonant frequency is shifted down (state 1) by the phase-controlling circuit. For example, the phase-controlling circuit may shift down the resonant frequency by switching in a small inductor, such as an inductor of less than 10 nH. The total efficiency 914 is when of the resonant frequency is shifted up (state 3) by the phase-controlling circuit. For example, the phase-controlling circuit may shift up the resonant frequency by switching in a first capacitor, such as a capacitor of 18 pF. The total efficiency 916 is when of the resonant frequency is shifted up by a different amount (state 4) by the phase-controlling circuit. For example, the phase-controlling circuit may shift up the resonant frequency by switching in a second capacitor, such as a capacitor of 6.88 pF. In this embodiment, the low band 902 is between 700 MHz and 960 MHz.

Figure 10:
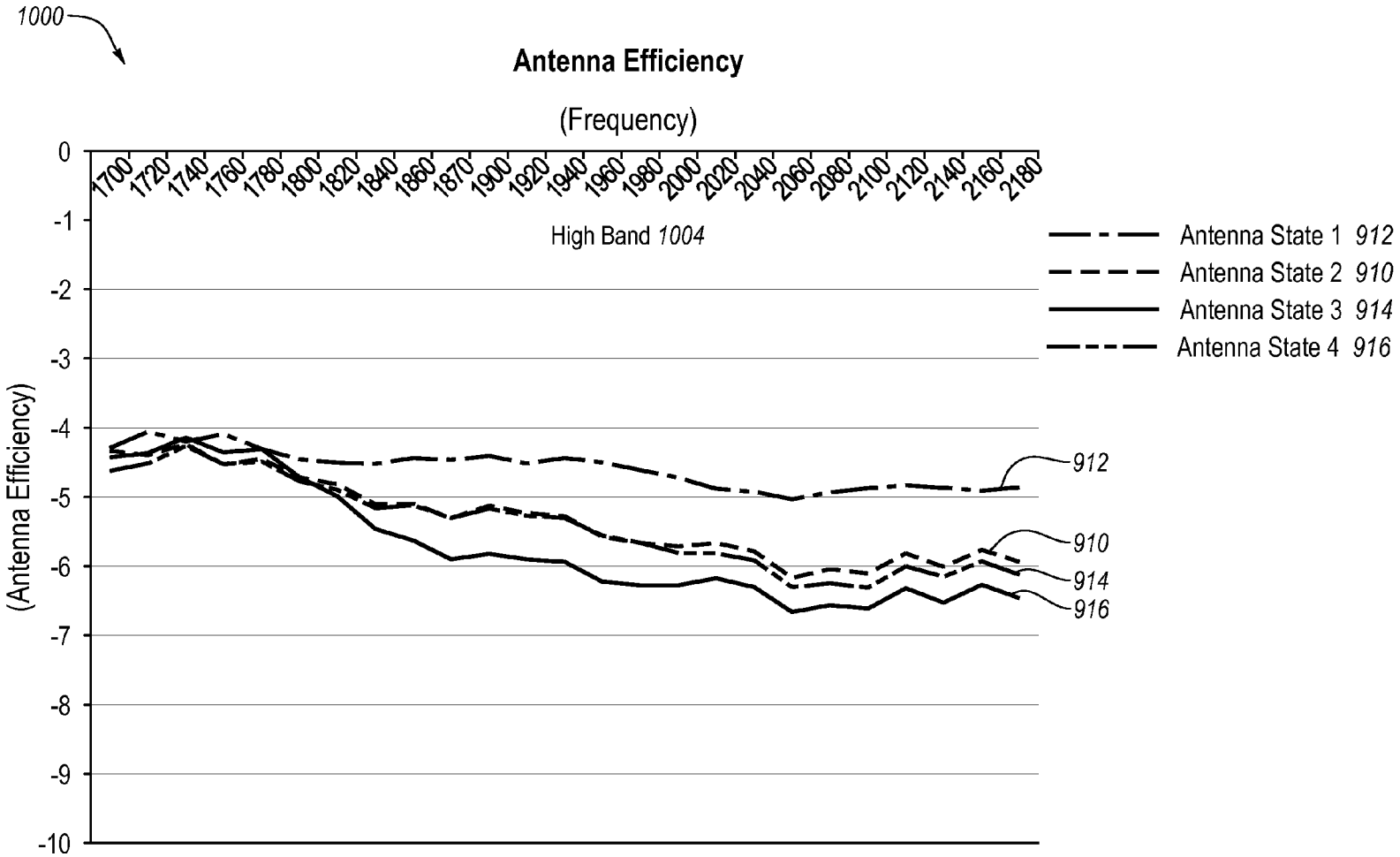
FIG. 10 a graph of measured efficiency of the phase-controlled, multi-mode wideband antenna of FIG. 7 in a high band according to one embodiment.

FIG. 10 a graph 1000 of measured efficiency of the phase-controlled, multi-mode wideband antenna 700 of FIG. 7 in a high band 1004 according to one embodiment. The total efficiency 910 of the antenna 700 is when no phase delay or phase advance is added (state 2) by the phase-controlling circuit. The total efficiency 912 is when of the resonant frequency is shifted down (state 1) by the phase-controlling circuit. For example, the phase-controlling circuit may shift down the resonant frequency by switching in a small inductor, such as an inductor of less than 10 nH. The total efficiency 914 is when of the resonant frequency is shifted up (state 3) by the phase-controlling circuit. For example, the phase-controlling circuit may shift up the resonant frequency by switching in a first capacitor, such as a capacitor of 18 pF. The total efficiency 916 is when of the resonant frequency is shifted up by a different amount (state 4) by the phase-controlling circuit. For example, the phase-controlling circuit may shift up the resonant frequency by switching in a second capacitor, such as a capacitor of 6.88 pF. In this embodiment, the high band 1004 is between 1.7 GHz and 2.2 GHz.

As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. The switchable scheme, using the phase-controlling circuit, could switch over individual band so that the peak efficiency is moved to correspond to that individual band. For example, the target band can be Verizon LTE band and the GSM850/900 band, and the phase-controlled, multi-mode wideband antenna 700 can be tuned to optimize the efficiency for this band as well as for other bands, such as DCS, PCS and WCDMA bands. The efficiency of the multi-mode wideband antenna 700 may be done by adjusting the phase of the antenna, such as by introducing a phase advance or a phase delay into the ground path of the antenna 700. As shown above, different values of inductance or capacitance can be switched in and out of the ground path to change the phase response. Similarly, a phase shifter circuit could be used to adjust the phase, such as in response to a voltage control signal from a control unit as described herein.

Figure 11:
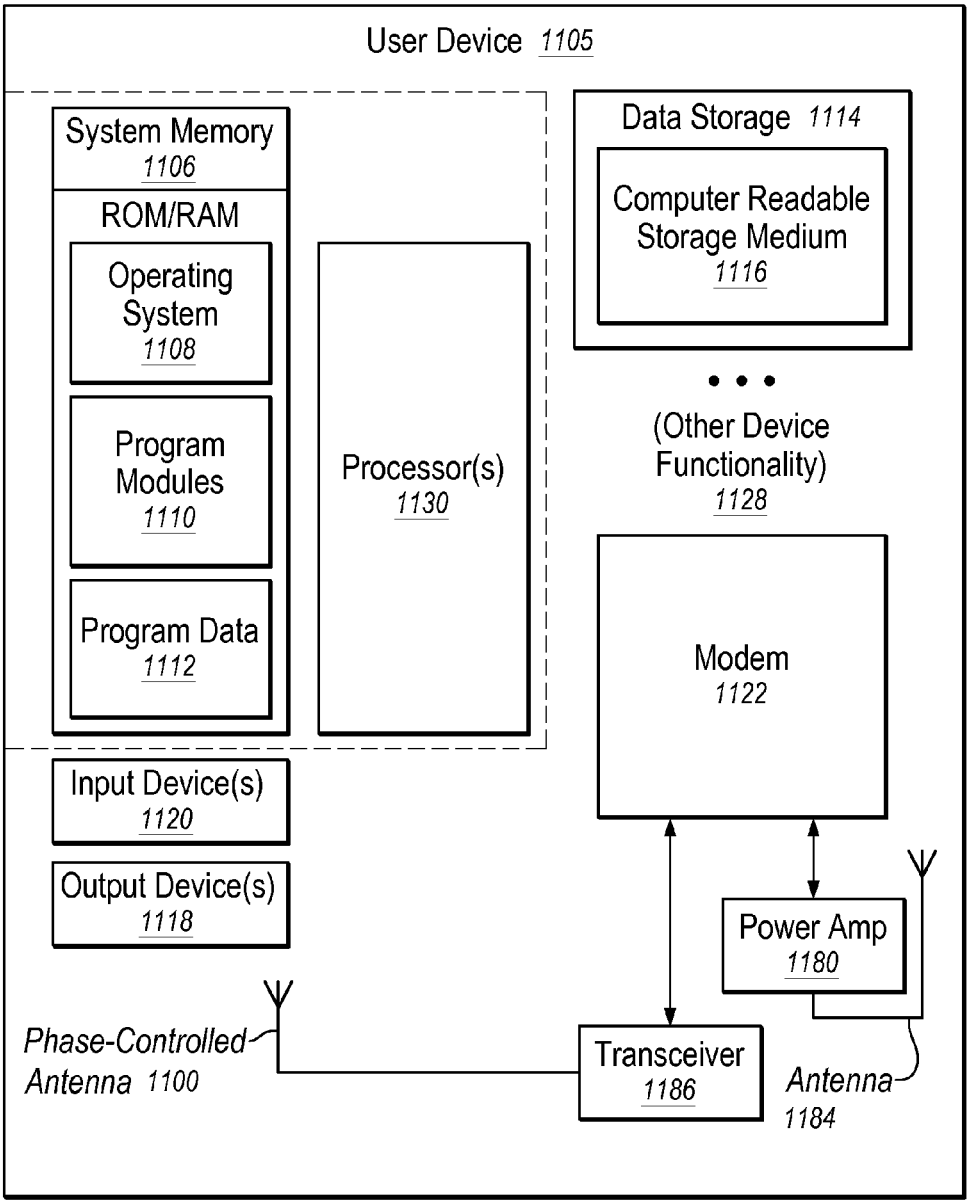
FIG. 11 is a block diagram of a user device having a phase-controlled antenna according to one embodiment.

FIG. 11 is a block diagram of a user device 1105 having the phase-controlled antenna 1100 according to one embodiment. The user device 1105 includes one or more processors 1130, such as one or more CPUs, microcontrollers, field programmable gate arrays, or other types of processing devices. The user device 1105 also includes system memory 1106, which may correspond to any combination of volatile and/or non-volatile storage mechanisms. The system memory 1106 stores information, which provides an operating system component 1108, various program modules 1110, program data 1112, and/or other components. The user device 1105 performs functions by using the processor(s) 1130 to execute instructions provided by the system memory 1106.

The user device 1105 also includes a data storage device 1114 that may be composed of one or more types of removable storage and/or one or more types of non-removable storage. The data storage device 1114 includes a computer-readable storage medium 1116 on which is stored one or more sets of instructions embodying any one or more of the functions of the user device 1105, as described herein. As shown, instructions may reside, completely or at least partially, within the computer readable storage medium 1116, system memory 1106 and/or within the processor(s) 1130 during execution thereof by the user device 1105, the system memory 1106 and the processor(s) 1130 also constituting computer-readable media. The user device 1105 may also include one or more input devices 1120 (keyboard, mouse device, specialized selection keys, etc.) and one or more output devices 1118 (displays, printers, audio output mechanisms, etc.).

The user device 1105 further includes a wireless modem 1122 to allow the user device 1105 to communicate via a wireless network (e.g., such as provided by a wireless communication system) with other computing devices, such as remote computers, an item providing system, and so forth. The wireless modem 1122 allows the user device 1105 to handle both voice and non-voice communications (such as communications for text messages, multimedia messages, media downloads, web browsing, etc.) with a wireless communication system. The wireless modem 1122 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 1122 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1105 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1105 to communicate with other devices, such as other user devices, server computing systems, telephone devices, or the like. In addition to wirelessly connecting to a wireless communication system, the user device 1105 may also wirelessly connect with other user devices. For example, user device 1105 may form a wireless ad hoc (peer-to-peer) network with another user device.

The wireless modem 1122 may generate signals and send these signals to power amplifier (amp) 1180 or transceiver 1186 for amplification, after which they are wirelessly transmitted via the phase-controlled antenna 1100 or antenna 1184, respectively. Although FIG. 11 illustrates power amp 1180 and transceiver 1186, in other embodiments, a transceiver may be used for all the antennas 1100 and 1184 to transmit and receive. Or, power amps can be used for both antennas 1100 and 1184. The antenna 1184, which is an optional antenna that is separate from the phase-controlled antenna 1100, may be any directional, omnidirectional or non-directional antenna in a different frequency band than the frequency bands of the phase-controlled antenna 1100. The antenna 1184 may also transmit information using different wireless communication protocols than the phase-controlled antenna 1100. In addition to sending data, the phase-controlled antenna 1100 and the antenna 1184 also receive data, which is sent to wireless modem 1122 and transferred to processor(s) 1130. It should be noted that, in other embodiments, the user device 1105 may include more or less components as illustrated in the block diagram of FIG. 11. In one embodiment, the phase-controlled antenna 1100 is the phase-controlled antenna 100 of FIG. 1. In another embodiment, the phase-controlled antenna 1100 is the phase-controlled antenna 500 of FIG. 5. Alternatively, the phase-controlled antenna 1100 may be other phase-controlled antennas as described herein.

In one embodiment, the user device 1105 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of the phase-controlled antenna 1100 that operates at a first frequency band and the second wireless connection is associated with a second resonant mode of the phase-controlled antenna 1100 that operates at a second frequency band. In another embodiment, the first wireless connection is associated with the phase-controlled antenna 1100 and the second wireless connection is associated with the antenna 1184. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1122 is shown to control transmission to both antennas 1100 and 1184, the user device 1105 may alternatively include multiple wireless modems, each of which is configured to transmit/receive data via a different antenna and/or wireless transmission protocol. In addition, the user device 1105, while illustrated with two antennas 1100 and 1184, may include more or fewer antennas in various embodiments.

The user device 1105 delivers and/or receives items, upgrades, and/or other information via the network. For example, the user device 1105 may download or receive items from an item providing system. The item providing system receives various requests, instructions and other data from the user device 1105 via the network. The item providing system may include one or more machines (e.g., one or more server computer systems, routers, gateways, etc.) that have processing and storage capabilities to provide the above functionality. Communication between the item providing system and the user device 1105 may be enabled via any communication infrastructure. One example of such an infrastructure includes a combination of a wide area network (WAN) and wireless infrastructure, which allows a user to use the user device 1105 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1105.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1105 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1105 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a radio frequency (RF) feed;

a folded monopole structure coupled to the RF feed and a phase-controlling circuit; and the phase-controlling circuit coupled between the folded monopole structure and a ground plane, the phase-controlling circuit to use a single pole switch to connect the folded monopole structure to one of a first path, a second path, or a third path, wherein:

the first path is the folded monopole structure connected to the ground plane to operate the folded monopole structure at a first resonant frequency;

the second path is the folded monopole structure connected to a capacitor that is connected in series with the ground plane to increase the first resonant frequency to a second resonant frequency of the folded monopole structure; or the third path is the folded monopole structure connected to an inductor that is connected in series with the ground plane to decrease the first resonant frequency to a third resonant frequency of the folded monopole structure, wherein the first path, the second path, and the third path are independent paths.

2. The electronic device of claim 1, wherein the single pole switch is a single pole, triple throw (SPTT) switch.

3. The electronic device of claim 1, wherein the phase-controlling circuit is configured to use the single pole switch to connect the folded monopole structure to a fourth path with a second capacitor coupled in series with the ground plane to increase the first resonant frequency to a fourth frequency of the folded monopole structure.

4. An apparatus comprising:

a radio frequency (RF) feed;

a folded monopole antenna structure coupled to the RF feed and a phase-controlling circuit, wherein the antenna structure is configured to operate at a first resonant frequency; and the phase-controlling circuit coupled between the antenna structure and a ground node, the phase-controlling circuit to connect, using a single pole switch, the antenna structure to a ground plane via one of a first conductive path, a second conductive path, or a third conductive path, wherein:

the first path connects the folded monopole antenna structure to the ground plane, wherein the first conductive path causes the folded monopole antenna structure to resonate at the first resonant frequency when a signal is applied to the RF feed, the second path connects the folded monopole antenna structure connected to a first capacitor that is connected-in series with the ground plane, wherein the second path causes the folded monopole antenna structure to resonate at a second resonant frequency when the signal is applied to the RF feed, wherein the second resonant frequency is higher than the first resonant frequency, or the third path connects the folded monopole antenna structure connected to a inductor that is connected-in series with the ground plane, wherein the third conductive path causes the folded monopole antenna structure to resonate at a third resonant frequency when the signal is applied to the RF feed, wherein the third resonant frequency is lower than the first resonant frequency, and the first path, the second path, and the third path are independent paths.

5. The apparatus of claim 4, wherein the single pole switch is to connect the folded monopole antenna structure to:

a first terminal of the first conductive path;

a second terminal of the second conductive path; or a third terminal of the third conductive path.

6. The apparatus of claim 4, wherein the phase-controlling circuit comprises a phase shifter coupled between the folded monopole antenna structure and the ground node.

7. The apparatus of claim 6, further comprising a control unit coupled to the phase shifter, wherein the control unit is configured to control the phase shifter using a control signal.

8. The apparatus of claim 6, wherein the phase shifter comprises a high-pass, low-pass network phase shifter.

9. The apparatus of claim 6, wherein the phase shifter comprises a loaded-line phase shifter.

10. The apparatus of claim 6, wherein the phase shifter comprises a switched line phase shifter comprising different transmission lines with different path lengths.

11. The apparatus of claim 4, wherein the folded monopole antenna structure comprises a folded monopole structure, wherein the folded monopole structure comprises:

a first arm coupled to the RF feed; and a folded arm coupled to the first arm, wherein the phase-controlling circuit is coupled between the folded arm and the ground node.

12. The apparatus of claim 4, wherein the folded monopole antenna structure comprises a loop structure, wherein the loop structure comprises:

a first end coupled to the RF feed; and a second end coupled to the phase-controlling circuit.

13. The apparatus of claim 4, wherein the folded monopole antenna structure comprises:

a first arm coupled to the RF feed;

a second arm coupled to the first arm;

a folded arm coupled to a distal end of the first arm and the phase-controlling circuit, wherein the distal end is the end farthest from the RF feed; and a third arm coupled to the distal end of the first arm, wherein the third arm comprises a plurality of extension traces.

14. The apparatus of claim 13, wherein the folded monopole antenna structure further comprises a parasitic ground element coupled to a grounding point of the ground plane, wherein the ground element comprises:

a first portion that is laid out at least partially in parallel to a portion of the second arm in a first direction until a first fold; and a second portion that folds towards the ground plane from the first fold and is laid out at least partially in parallel to the first portion for a specified distance from the first fold, wherein the first portion and the second arm form a coupling between the folded monopole antenna structure and the parasitic ground element.

15. The apparatus of claim 14, wherein the second arm comprises a first coupler section, and wherein the first arm comprises:

a feed trace;

a widened section; and a second coupler section, wherein the first coupler section and the second coupler section are disposed to form an inductive coupling between the first arm and the second arm.

16. The apparatus of claim 4, wherein the folded monopole antenna structure is configured to radiate electromagnetic energy in a first frequency range and to radiate electromagnetic energy in a second frequency range, wherein the first frequency range is approximately 700 MHz to approximately 960 MHz and the second frequency range is approximately 1.7 GHz to approximately 2.2 GHz.

17. A method of comprising:

coupling a folded monopole antenna structure to a ground node via a phase-controlling circuit coupled between the folded monopole antenna structure and the ground node;

switching a single pole switch of the phase controlling circuit to connect the folded monopole antenna structure to a ground plane via one of a first conductive path, a second conductive path, or a third conductive path, wherein:

the first path connects the folded monopole antenna structure connected to the ground plane, wherein the first conductive path causes the folded monopole antenna structure to resonate at a first resonant frequency when a signal is applied to the folded monopole antenna structure;

the second path connects the folded monopole antenna structure connected to a capacitor that is connected in series with the ground plane, wherein the second conductive path causes the folded monopole antenna structure to resonate at a second resonant frequency when the signal is applied to the folded monopole antenna structure, wherein the second resonant frequency is higher than the first resonant frequency; or the third path is the folded monopole antenna structure connected to an inductor that is connected in series with the ground plane, wherein the third conductive path causes the folded monopole antenna structure to resonate at a third resonant frequency when the signal is applied to the folded monopole antenna structure, wherein the third resonant frequency is lower than the first resonant frequency, and the first conductive path, the second conductive path, and the third conductive path are independent paths.

* * * * *